US005495632A

United States Patent [19]

Baker

[11] Patent Number: 5,495,632

[45] Date of Patent: Mar. 5, 1996

[54] MOTORIZED HAND HELD SCRUBBER

[76] Inventor: Rhonda Baker, 3030 Acacia #M203, Hemet, Calif. 92544

[21] Appl. No.: 335,553

[22] Filed: Nov. 7, 1994

Related U.S. Application Data

[63] Continuation of Ser. No. 55,559, May 3, 1993, abandoned.

[51] Int. Cl.[6] ..... A46B 13/02

[52] U.S. Cl. ..... 15/4; 15/23; 15/28; 15/97.1; 401/195; 401/208

[58] Field of Search ..... 15/28, 29, 97.1, 15/27, 4

[56] References Cited

U.S. PATENT DOCUMENTS

| | | | |
|---|---|---|---|
| 1,232,517 | 7/1917 | Ely | 15/27 |
| 1,568,408 | 1/1926 | Miles | 15/28 |
| 1,571,773 | 2/1926 | Force | 15/28 |
| 2,140,307 | 12/1938 | Belaschk et al. | 15/28 |
| 2,547,057 | 4/1951 | Stieglitz | 15/97.1 |
| 2,597,971 | 5/1952 | Burnham | 15/97.1 |
| 2,615,192 | 10/1952 | Morell | 15/28 |
| 3,114,924 | 12/1963 | Morrison | 15/97.1 |
| 4,209,292 | 5/1980 | Lester | 15/28 |
| 4,924,550 | 5/1990 | Wu | 15/29 |
| 5,173,983 | 12/1992 | Le | 15/28 |
| 5,222,268 | 6/1993 | Snodgress | 15/105 |

FOREIGN PATENT DOCUMENTS

| | | | |
|---|---|---|---|
| 572993 | 6/1924 | France | 15/97.1 |
| 2057704 | 5/1971 | Germany | 15/28 |

*Primary Examiner*—Stephen F. Gerrity
*Assistant Examiner*—Terrence R. Till

[57] ABSTRACT

An elongated hand held scrubbing device has a pair of motor-driven rotary hubs, onto which a variety of easily replaceable cleaning heads can be temporarily mounted. Different types and styles of cleaning heads can be used based on the type of scrubbing, buffing, wiping or cleaning required. The elongated device has a pivot making it easier to scrub hard to reach locations.

8 Claims, 5 Drawing Sheets

FIG 9
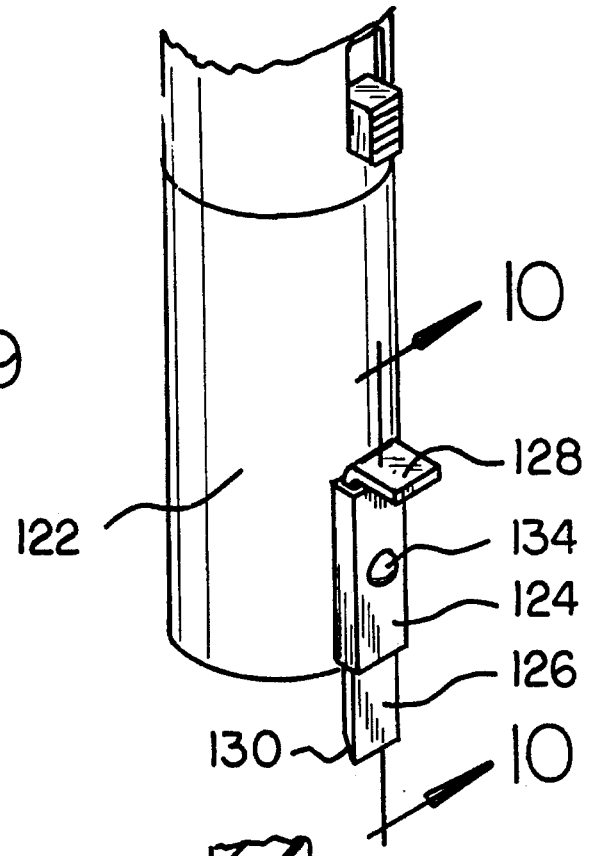
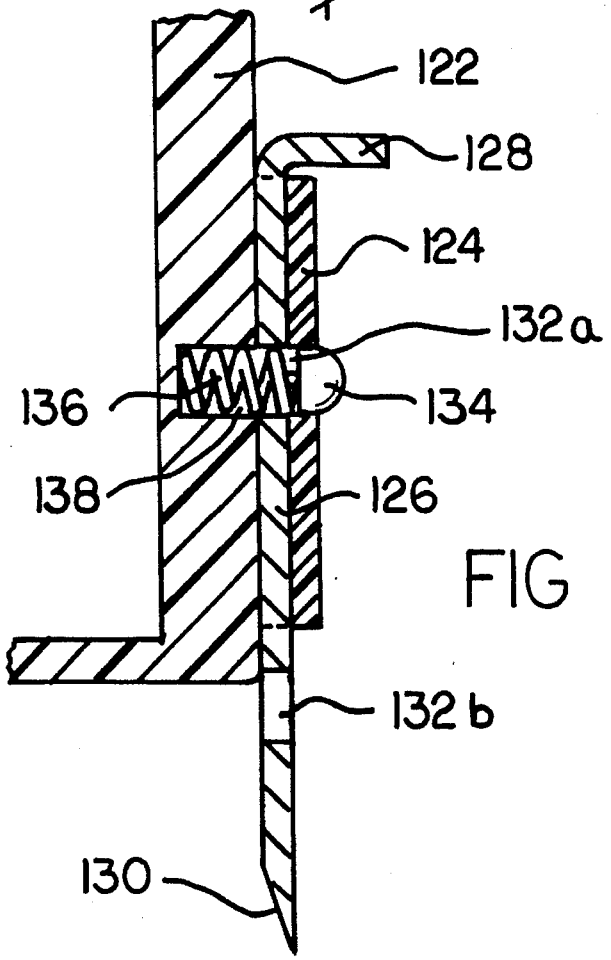
FIG 10

MOTORIZED HAND HELD SCRUBBER

This application is a continuation of application Ser. No. 08/055,559, filed May 3, 1993, now abandoned.

BACKGROUND OF THE INVENTION

1. Field of the Invention

The present invention relates generally to cleaning devices, and more particularly, to a motorized hand held scrubber.

2. Description of the Prior Art

Hand scrubbers in the form of stiff wire scouring brushes are well known in the art of cleaning devices. These prior art brushes typically are comprised of a wire turned on itself, the wire having bristles attached and the wire connected to a solid wooden handle. Cleaning with the prior art brushes requires a lot of hard work on the part of the user and the brushes are typically limited to a single type of wiping use such as scraping. What is needed is a new device which reduces or eliminates the hard work required with the old devices and which can be used for a variety of different wiping situations and purposes.

Thus, while the foregoing body of prior art indicates it to be well known to use scrubbers for cleaning surfaces an effective device requiring less physical exertion to use is not contemplated. Nor does the prior art described above teach or suggest a single motorized scrubbing device which may be angularly bent and which may be used by individuals to alternately scrub, buff, wipe or otherwise clean as is needed.

The foregoing disadvantages are overcome by the unique hand held motorized scrubber of the present invention as will be made apparent from the following description thereof. Other advantages of the present invention over the prior art also will be rendered evident.

SUMMARY OF THE INVENTION

To achieve the foregoing and other advantages, the present invention, briefly described, provides an elongated hand held scrubbing device having a pair of motor-driven rotary hubs, onto which a variety of easily replaceable cleaning heads can be temporarily mounted. Different types and styles of cleaning heads can be used based on the type of scrubbing, buffing, wiping or cleaning required. The elongated device has a pivot making it easier to scrub hard to reach locations.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new motorized hand held scrubber which has all of the advantages of the prior art and none of the disadvantages.

It is another object of the present invention to provide a new motorized hand held scrubber which may be easily and efficiently manufactured and marketed.

It is a further objective of the present invention to provide a new motorized hand held scrubber which is of durable and reliable construction.

An even further object of the present invention is to provide a new motorized hand held scrubber which is susceptible of a low cost of manufacture with regard to both materials and labor, and which accordingly is then susceptible of low prices of sale to the consuming public, thereby making such motorized hand held scrubber available to the buying public.

Still yet a further object of the present invention is to provide a new motorized hand held scrubber having a pair of motor-driven rotary hubs, onto which a variety of easily replaceable cleaning heads can be temporarily mounted.

It is still a further object of the present invention is to provide a new motorized hand held scrubber on which different types and styles of cleaning heads can be used based on the type of scrubbing, buffing, wiping or cleaning required.

Still a further object of the present invention is to provide a new motorized hand held scrubber including means for pivoting the middle of the elongated device to make it easier to scrub hard to reach locations.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 9 is a perspective view in elevation of a alternative preferred embodiment of the lower part of a motorized hand held scrubber having a retractable scraper in accordance with the invention.

FIG. 10 is a partial cross-sectional side view in of the alternative preferred embodiment of the motorized hand held scrubber of the present invention of FIG. 9 taken along 9—9.

DESCRIPTION OF THE PREFERRED EMBODIMENT

With reference now to the drawings, a new and improved motorized hand held scrubber embodying the principles and concepts of the present invention will be described.

Figures 1, 2, 3:
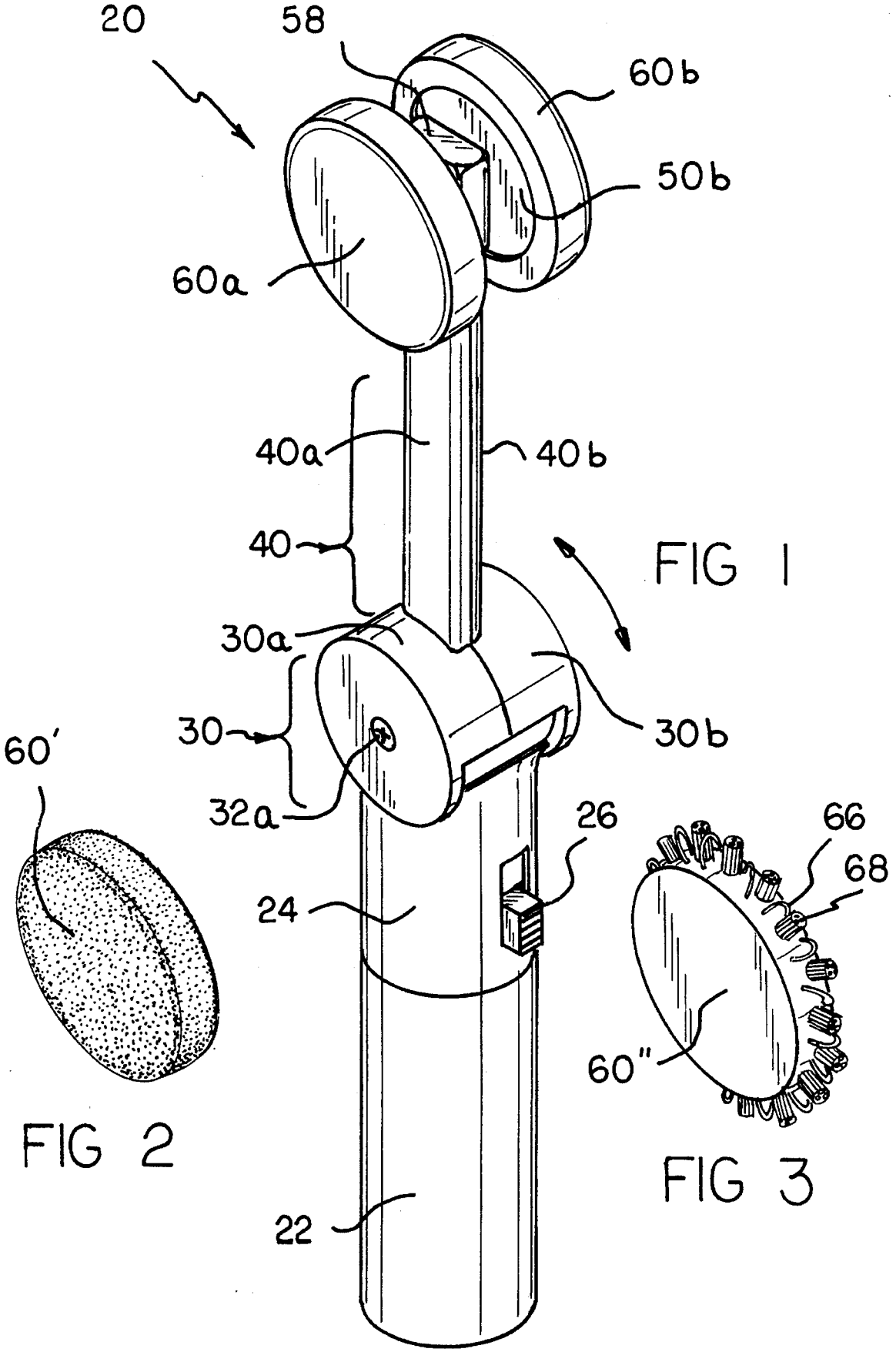
FIG. 1 is a perspective view showing the first preferred embodiment of the motorized hand held scrubber having mounted thereon a first type of head, all in accordance with the present invention.
FIG. 2 is a perspective of a second type of head which can be mounted onto the motorized scrubber of FIG. 1 all in accordance with the present invention.
FIG. 3 is a perspective of a third type of head which can be mounted onto the motorized scrubber of FIG. 1 all in accordance with the present invention.
Figure 4:
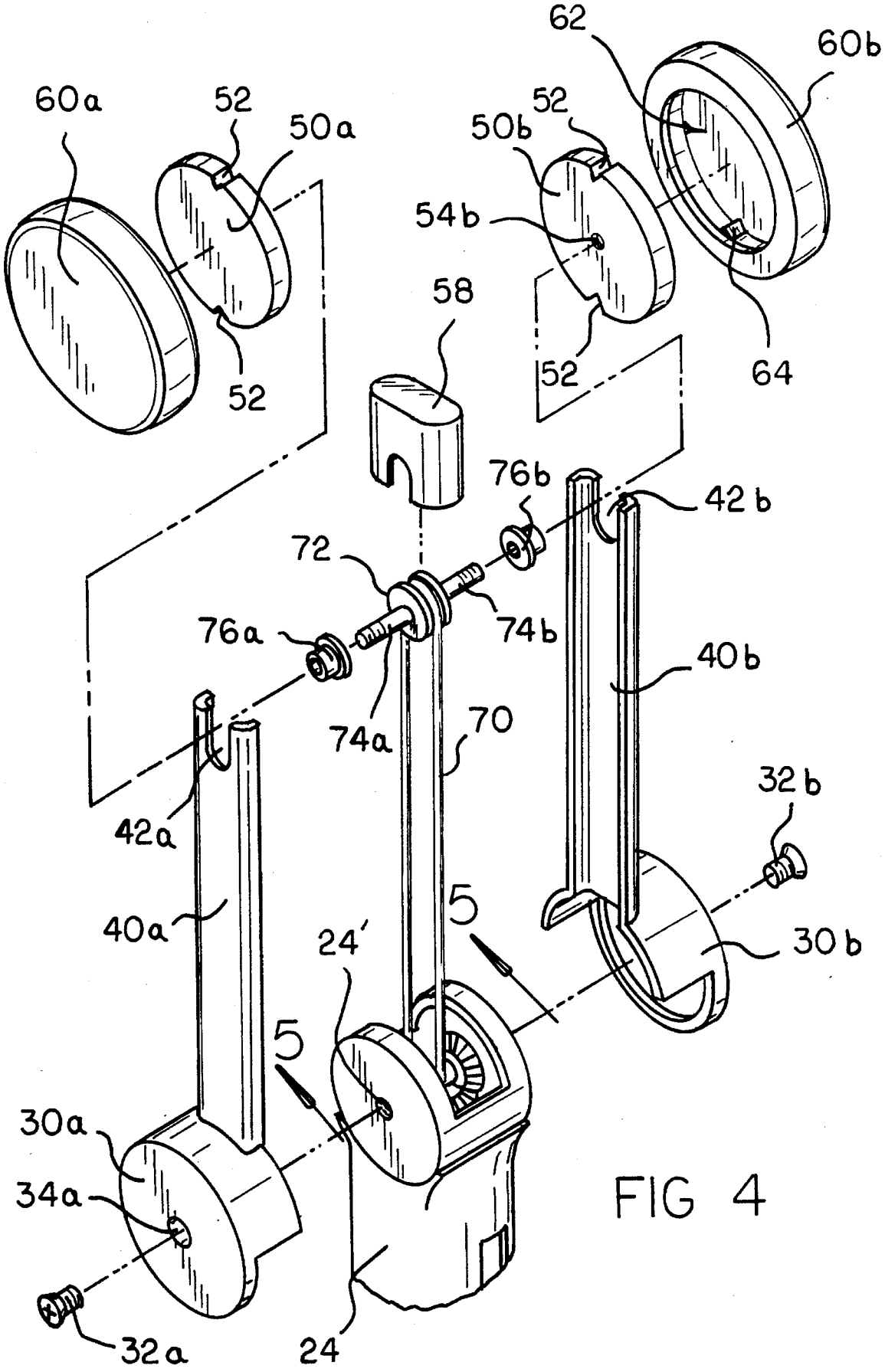
FIG. 4 is a perspective view of the motorized hand held scrubber of FIG. 1 shown with parts separated in accordance with the present invention.

Turning initially to FIGS. 1 and 4, there is shown a first exemplary embodiment of the motorized hand held scrubber of the present invention generally designated by reference numeral 20. In its preferred form, motorized hand held scrubber 20 comprises generally a lower handle (and battery case) section 22 and an upper handle section 24, each having corresponding threaded sections 22' and 24' (see FIG. 5) so that the two sections they can be screwed together and unscrewed for the replacing of batteries. An on/off switch 26 is preferably located on the upper handle section 24 where it can be easily switched on and off by a user's thumb. The hand held scrubber 20 further comprises a neck section 40 and a pivot section 30 below and preferably made or molded unitarily with the neck section 40. The neck 40/pivot 30 section is preferably made of two half sections screwed together so that they can be unscrewed when necessary for cleaning and repairing the inner workings of the scrubber 20. The first half section is comprised of the combination of first pivot half section 30*a* and first neck half section 40*a*. The second half section is comprised of the combination of second pivot half section 30*b* and second neck half section 40*b*. As shown in FIG. 4, the upper handle section is shaped so as to define an unlabeled mounting cylinder to which the neck sections are pivotally mounted. A pair of screws 32*a* and 32*b* hold the pivot/neck sections to the mounting cylinder of the upper handle section in such a way that the neck 40 can pivot with respect to the handle. Screw holes 34*a* and 34*b* (not shown) in the pivot section are not threaded while the screw holes 24' near the top of the upper handle section 24 are threaded. Thus, while the threaded holes 24' remain fixed with respect to the screws 32*a* and 32*b*, the edges of the non-threaded holes 34*a* and 34*b* can slide around the screw, allowing the pivot section 30 and its attached neck section 40 to pivot with respect to the handle. With continuing nreference FIG. 4, the first pivot half section 30*a* and the second pivot half section 30*b* each comprise an unlabeled circular plate having a semi-cylindrical projection (not labeled) extending substantially orthogonally therefrom. The semi-cylindrical projections each include a first arcuate edge attached to an arcuate edge of the respective circular plate, and a second arcuate edge spaced from the circular plate. The neck half sections 30*a* and 30*b* each project from the second arcuate edge of the respective semi-cylindrical projection, with the semi-cylindrical projections cooperating with the circular plates to define a cavity within which the mounting cylinder is positioned.

As can be seen most clearly in FIG. 4, a pair of U-shaped slots are located at the top of the respective neck halves 40*a* and 40*b*.

A first hub 50*a* and a second hub 50*b* have respective notches 50*a* and 50*b* and threaded center hole 54*a* and 54*b* partially running through the respective hubs 50*a* and 50*b* (hole 54*a* not shown). The hubs are specially adapted to removably hold a variety of different scrubbing, cleaning, wiping and/or buffing heads. A first type of cleaning head 60*a* and 60*b* is shown in FIGS. 1 and 4. Other types of heads are shown in FIGS. 3 and 4. FIG. 2 shows a sponge type wiping head 60'. FIG. 3 shows a scrubbing type head 60" having wire chippers 66 and bristles 68 for tough scrubbing. These exemplary heads and other wiping/cleaning/scrubbing/etc. heads can be interchangeably used with the present invention.

Looking at the broken apart view of FIG. 4, the preferred inner parts of the present invention motorized hand held scrubber 20 can be more clearly seen. The heads 60*a* (not shown) and 60*b* are hollow such that the heads 60*a* and 60*b* fit tightly over the respective hubs 50*a* and 50*b*. Catch cams 64 can be used to mate with notches 52 to temporarily lock the heads 60*a* and 60*b* to the hubs 50*a* and 50*b*.

A motor-driven band 70 runs over band sprocket part 72. The band sprocket part 72 has two threaded pieces 74*a*, 74*b* protruding respectively from opposite sides of the sprocket part 72. Two flanged bushings 76*a* and 76*b* are used to hold the threaded pieces 74*a* and 74 within the U-shaped slots 42*a* and 42*b* respectively. The threaded pieces 74*a* and 74*b* can slidably rotate within the bushings. However, the threads of the threaded pieces 74*a* and 74*b* match with the threaded holes 54*a* and 54*b* in the hubs 50*a* and 50*b*. Thus, if the threaded pieces 74*a* and 74*b* rotate within the bushings 76*a* and 76*b*, the hubs 60*a* and 60*b* (and any attached heads 60*a* and 60*b* ) will also rotate (when tightly threaded together).

A cap 58 having U-shaped slots covers the band sprocket to seal and protect the inner workings of the device.

Figure 6:
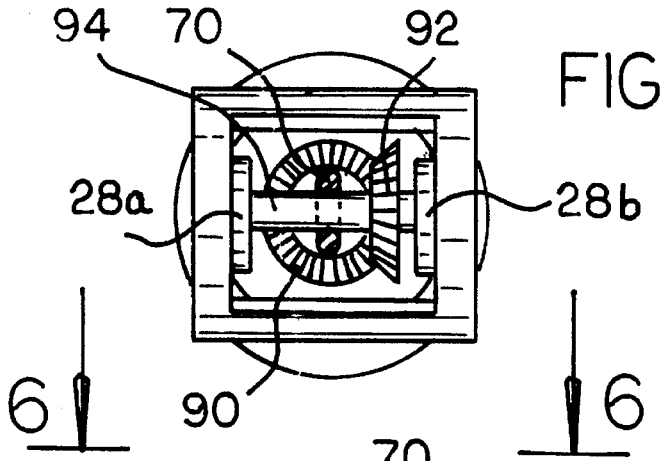
FIG. 6 is a top view of the lower section of the motorized hand held scrubber along line 6—6 of FIG. 5.
Figure 5:
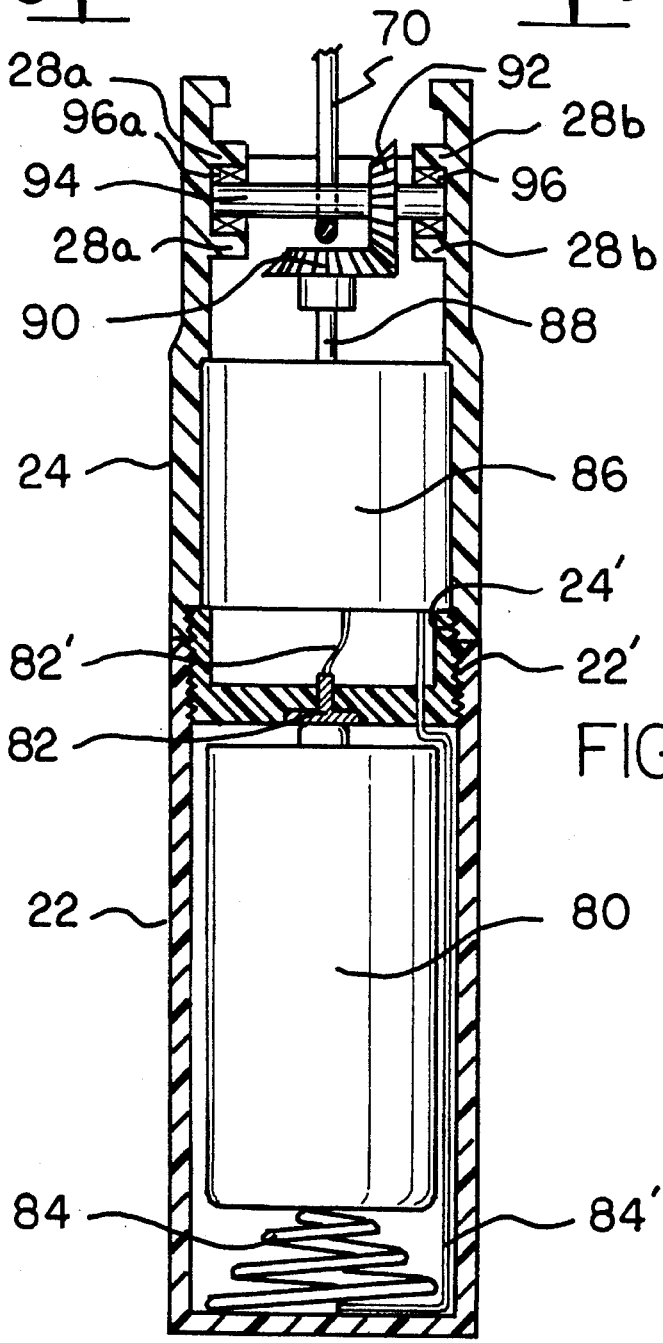
FIG. 5 is a cross-sectional side elevational view of the lower section of the motorized hand held scrubber along line 5—5 of FIG. 4.

Referring now to FIGS. 5 and 6, the present invention is preferably powered by a battery such as the battery shown by reference numeral 80. Battery 80 is mounted inside the device with wire 82' running from positive pole 82 to a motor 86. Wire 84' runs from negative spring pole 82 to the motor 86. A motor bar 88 can be turned by the power of motor 86. A first gear 90 can be caused to turn by turning of the motor bar 88. A second gear 92 can be caused to turn by any turning of the first gear 90. Bar 94 can be caused to rotate by any turning of second gear 92. The bar 94 is held in position and allowed to turn by bearings 96*a* and 96*b*. The bearings 96*a* and 96*b* are held in position by protruding round sections 28*a* and 28*b* located inside and near the top of upper handle section 24.

Use of the hand held motorized scrubbing device is very simple. The neck/pivot section is pivoted to the desired angle (preferably up to 45 degrees). The desired type of heads are attached to the hubs 50*a* and 50*b*. The switch 26 is turned on, completing the battery 80 circuit which runs the motor 86. Motor bar 88 is turned by the power of the motor 86. First gear 90 is turned by the turning of the motor bar 88. Second gear 92 is turned by the turning of the first gear 90. Bar 94 is rotated as second gear 92 turns. The turning of bar 94 forces the band 70 to move in the direction of the turning. The moving band 70 turns the band sleeve 72 and its threaded sections 74*a* and 74*b*. The turning of the threaded sections 74*a* and 74*b* causes the hubs 50*a* and 50*b* to rotate along with the attached heads. The quickly rotating heads can then be used to clean, wipe, scrub or buff as is required. When the work is complete the switch is turned off and the heads can be removed from the hubs 50*a* and 50*b*.

Figure 7:
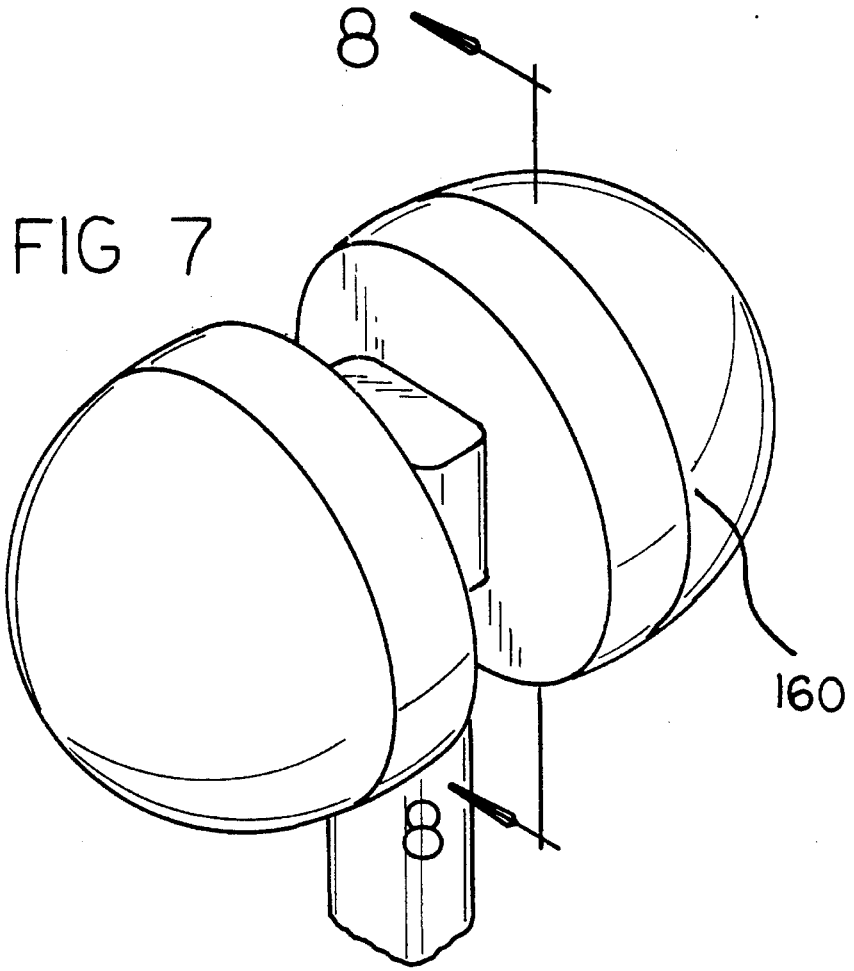
FIG. 7 is a perspective view in elevation of a alternative preferred embodiment of the upper part of a motorized hand held scrubber in accordance with the invention.
Figure 8:
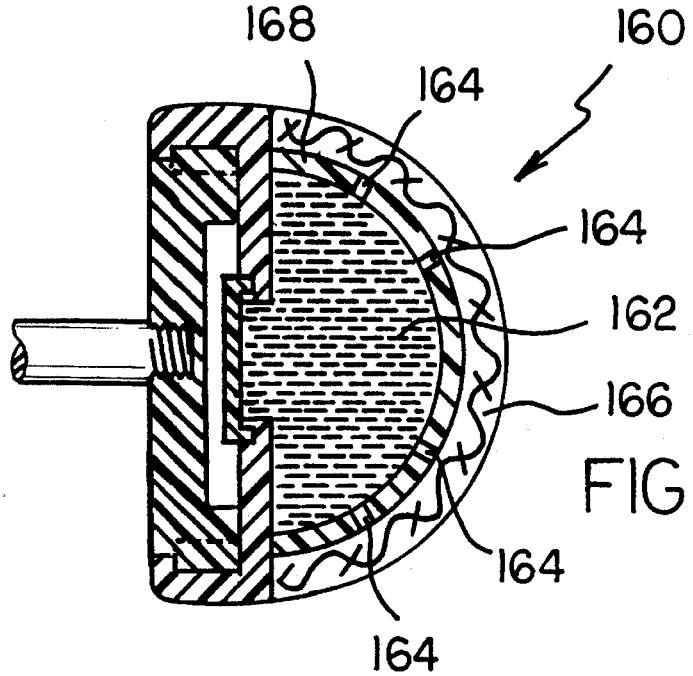
FIG. 8 is a partial cross-sectional side view in of the alternative preferred embodiment of the invention of FIG. 7 taken along 8—8.

An alternative type of head 160 is shown in FIGS. 7 and 8. A fluid reservoir 162 is contained inside the head 160. The fluid used could be any type of cleaning or polishing liquid (such as wax or soap) or water as may be required. Holes 164 are positioned through a barrier wall 168 to allow the fluid to flow out of the reservoir 162. The outside surface of the head is a buffing or cleaning material 166.

Use of the alternative embodiment head 160 is the same as the earlier embodiments except that liquid is provided form the reservoir 162 during use for cleaning or polishing. The alternative embodiment head 160 can be exchanged on the present invention device with one of the earlier embodiment heads.

An alternative lower handle section 122 is shown in FIGS. 9 and 10. The alternative handle 122 has a scraper 126 which can be used when desired to scrape away hard grit that the rotating scrubber won't remove. The scraper 126 has a use and a non-use position so that it can't be safely kept out of the way when not in use. The use position is shown in the Figures. The scraper holder 124 holds the scraper 126 against the outer wall of the handle section 122. A turned top section 128 of the scraper 126 keeps the scraper 126 from falling through the scraper holder 124. At the bottom of the scraper 126 is scraping section 130.

A first hole 132*a* in the scraper 126 holds the scraper 126 in the use position. A second hole 132*b* in the scraper 126 holds the scraper 126 in the non scraping position. A button 134 which is spring loaded by spring 136 can be pushed into a hole 138 in the handle section 122 against the force of the spring 136. The button 134 passes through either hole 132*a* (when the scraper is in the scraping position as shown in the Figures) or hole 132*b* (when the scraper 126 is in the non-scraping position). The scraper 126 can be slid up and down when the button 134 is pushed through either of the scraper holes 132*a* or 132*b* past the back edge of the scraper 126 until the other hole is reached and the button 134 pops back out from the force of spring 136.

It should be noted that the heads shown in the Figures are shown in their preferred sizes relative to the neck and the handle. However, smaller or larger heads could be used and should be considered within the scope of the present invention. Also, the heads could be attached to the hubs and the hubs could be attached to the drive mechanism using any type of coupling means such as and for example, a snap coupling or a threaded coupling. A key could also be used to lock the parts together. The drive belt of the present invention could also alternatively engage with a sprocket attached to the drive axle so that the belt can't wander oil the axle, though controlling the clearance between bearings should also prevent any belt wandering.

The body of the present invention is preferably made of a hard plastic material (but any material could be used within the scope of the invention). Thus corrosion should not be a problem. The scrubber head surfaces can be made of any number of materials including but not limited to: mesh (soft/fine teflon dobie type; or coarse teflon dobie type); sponge (soft and thick; or firm and thin; or a hard course layer of teflon over a softer base); buffer (wet/wax with or without a reservoir hub; or dry); and combinations such as soft and hard sponge or mesh with string integrated; etc.

The neck can be allowed to rotate preferably up to 45 degrees. While the preferred embodiments are shown with two hub and head setups, it should be understood that any number (including only one) of hub and head set-ups could be used within the scope of the invention.

It is apparent from the above that the present invention accomplishes all of the objectives set forth by providing a new hand-held surface wiping device made up of: an elongated body having at one end at least one rotatable hub means; a motorized drive means for rotating the rotatable hub means; at least one head which can be mounted on the rotatable hub means head to rotate and wipe a surface as the head rotates. The at least one rotatable hub means and the at least one head can be two rotatable hub means and two heads. The invention can further have a variety of easily exchangeable cleaning/wiping/buffing heads which can be temporarily mounted onto the at least one rotatable hub means. The wiping device can be alternately used :for scrubbing, buffing, wiping or cleaning. The invention can further have a means for pivoting the middle of the elongated device, whereby the device will be more easily able to reach and wipe hard to reach locations. The at least one head can contain a fluid containing chamber which can release fluid for use during the wiping.

With respect to the above description, it should be realized that the optionurn dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Itence, the proper scope of the present invention should be determined only by the broadest interpretation of the appended claims so as encompass all such modifications and equivalents.

What is claimed as being new and desired to be protected by Letters Patent of the United States is as follows:

1. A motorized scrubber comprising:

a first elongated body portion having opposed first and second ends defining a handle for said scrubber, said handle having a first longitudinal axis passing through said first and second ends defining said handle, a second elongated body portion having opposed first and second ends defining a head and neck for said scrubber, said head and neck having a second longitudinal axis passing through said first and second ends defining said head and neck, means for pivotally connecting said head and neck to said handle such that said head and neck is movably adjustable relative to said handle through a range of positions where said first axis is co-linear with said second axis in a first position and where said first axis makes an angle with respect to said second axis in a second position, a cleaning member;

axle means for supporting said cleaning member for rotation about an axis extending orthogonally with respect to at least said second axis, means on said head and neck proximal to said first opposed end of said elongated body portion for mounting said axle means for rotation thereon, motor means for rotating said axle means to cause said cleaning member to rotate about said orthogonal axis, said first elongated body portion having a first hollow interior space, said motor means being mounted in said first hollow interior space and having an output shaft, transmission means for connecting said motor means output shaft to said axle means, said second elongated body portion having a second hollow interior space, and said transmission means extending through said second hollow interior space and being movably adjustable through said range of motions of said head and neck relative to said handle, wherein said cleaning member comprises a hub adapted to mounted on said axle means, said hub having a removable head mounted thereto, said removable head comprising a hemispherically shaped hollow housing for defining an enclosed reservoir adapted to contain a liquid cleaning substance, said housing comprising a porous wall for allowing said substance to flow from said reservoir to the exterior of said housing during rotation of said cleaning member on said axle means.

2. A motorized scrubber comprising:

a first elongated body portion having opposed first and second ends defining a handle for said scrubber, said handle having a first longitudinal axis passing through said first and second ends defining said handle, a second elongated body portion having opposed first and second ends defining a head and neck for said scrubber, said head and neck having a second longitudinal axis passing through said first and second ends defining said head and neck, means for pivotally connecting said head and neck to said first end of said handle such that said head and neck is movably adjustable relative to said handle through a range of positions where said first axis is co-linear with said second axis in a first position and where said first axis makes an angle with respect to said second axis in a second position, an axle rotatably mounted to said second elongated body portion proximal to said head thereof for rotation about an axis extending orthogonally relative to said second axis, said axle having opposed first and second ends;

a first hub fixedly secured to said first end of said axle, and a second hub fixedly secured to said second end of said axle;

a first cleaning member having a work engaging face, said first cleaning member being removably coupled to said first hub such that said work engaging face of said first cleaning member projects in a first outward direction; and, a second cleaning member having a work engaging face, said second cleaning member being removably coupled to said second hub such that said work engaging face of said second cleaning member projects in a second outward direction oppositely oriented relative to said first outward direction, wherein said first end of said first elongated body portion is shaped so as to define a mounting cylinder, and further wherein said second elongated body portion comprises a first half section including a first pivot half section with a first neck half section projecting therefrom, and a second half section including a second pivot half section with a second neck half section projecting therefrom, said first and second pivot half sections being rotatably mounted to opposed ends of said mounting cylinder such that said first and second neck half sections are positioned in an abutting relationship.

3. The motorized scrubber of claim 2, wherein said first pivot half section and said second pivot half section each comprise a circular plate having a semi-cylindrical projection extending substantially orthogonally therefrom, said semi-cylindrical projections each including a first arcuate edge attached to an arcuate edge of the respective circular plate, and a second arcuate edge spaced from said circular plate, said neck half sections each projecting from the second arcuate edge of the respective semi-cylindrical projection, said semi-cylindrical projections cooperating with said circular plates to define a cavity within which said mounting cylinder is positioned.

4. The motorized scrubber of claim 3, and further comprising means for rotating said axle relative to said second elongated body portion.

5. The motorized scrubber of claim 2, wherein said hubs are each comprise a substantially circular plate shaped so as to define diametrically opposed notches, and further wherein said cleaning members each include diametrically opposed catch cams positioned within the respective notches.

6. The motorized scrubber of claim 5, and further comprising means for rotating said axle relative to said second elongated body portion.

7. A motorized scrubber comprising:

a first elongated body portion having opposed first and second ends defining a handle for said scrubber, said handle having a first longitudinal axis passing through said first and second ends defining said handle, said first end of said first elongated body portion being shaped so as to define a mounting cylinder;

a second elongated body portion having opposed first and second ends defining a head and neck for said scrubber, said head and neck having a second longitudinal axis passing through said first and second ends defining said head and neck, said second elongated body portion comprising a first half section including a first pivot half section with a first neck half section projecting therefrom, and a second half section including a second pivot half section with a second neck half section projecting therefrom, said first and second pivot half sections being rotatably mounted to opposed ends of said mounting cylinder such that said first and second neck half sections are positioned in an abutting relationship means for pivotally connecting said head and neck to said first end of said handle such that said head and neck is movably adjustable relative to said handle through a range of positions where said first axis is co-linear with said second axis in a first position and where said first axis makes an angle with respect to said second axis in a second position, an axle rotatably mounted to said second elongated body portion proximal to said head thereof for rotation about an axis extending orthogonally relative to said second axis, said axle having opposed first and second ends;

a first hub fixedly secured to said first end of said axle, and a second hub fixedly secured to said second end of said axle; and, a first cleaning member having a work engaging face, said first cleaning member being removably coupled to said first hub, wherein said first pivot half section and said second pivot half section each comprise a circular plate having a semi-cylindrical projection extending substantially orthogonally therefrom, said semi-cylindrical projections each including a first arcuate edge attached to an arcuate edge of the respective circular plate, and a second arcuate edge spaced from said circular plate, said neck half sections each projecting from the second arcuate edge of the respective semi-cylindrical projection, said semi-cylindrical projections cooperating with said circular plates to define a cavity within which said mounting cylinder is positioned.

8. The motorized scrubber of claim 7, and further comprising means for rotating said axle relative to said second elongated body portion.

* * * * *